US010403191B2

(12) United States Patent
Tang et al.

(10) Patent No.: US 10,403,191 B2
(45) Date of Patent: Sep. 3, 2019

(54) LED DISPLAY DEVICE AND METHOD FOR IMPROVING IMAGE QUALITY USING A SCHEME OF ROW LINE RESETTING

(71) Applicant: Chipone Technology (Beijing) Co., Ltd, Beijing (CN)

(72) Inventors: Yongsheng Tang, Beijing (CN); Yong Wang, Beijing (CN); Xingbo Gao, Beijing (CN); Haifeng Liu, Beijingent (CN)

(73) Assignee: Chipone Technology (Beijing) Co., LTD, Beijing (CN)

( * ) Notice: Subject to any disclaimer, the term of this patent is extended or adjusted under 35 U.S.C. 154(b) by 45 days.

(21) Appl. No.: 15/689,903

(22) Filed: Aug. 29, 2017

(65) Prior Publication Data

US 2018/0090048 A1 Mar. 29, 2018

(30) Foreign Application Priority Data

Sep. 29, 2016 (CN) ..... 2016 1 0867290

(51) Int. Cl.

*G09G 3/20* (2006.01)
*G09G 3/32* (2016.01)
*G09G 3/3216* (2016.01)

(52) U.S. Cl.

CPC ..... *G09G 3/2018* (2013.01); *G09G 3/32* (2013.01); *G09G 3/3216* (2013.01); *G09G 2310/0248* (2013.01); *G09G 2310/0251* (2013.01); *G09G 2310/061* (2013.01); *G09G 2310/08* (2013.01); *G09G 2320/0257* (2013.01); *G09G 2370/10* (2013.01)

(58) Field of Classification Search

CPC ..... G09G 3/2018; G09G 3/32; G09G 3/3216; G09G 2310/0251; G09G 2310/061; G09G 2310/0248; G09G 2320/0257; G09G 2370/10; G09G 2310/08

See application file for complete search history.

(56) References Cited

U.S. PATENT DOCUMENTS

2002/0163513 A1* 11/2002 Tsuji ..... G06F 3/1446 345/204
2006/0279492 A1* 12/2006 Chen ..... G09G 3/3216 345/77
2008/0043046 A1* 2/2008 Hong ..... G09G 3/3216 345/691

FOREIGN PATENT DOCUMENTS

CN 105825806 A 8/2016
CN 205810342 U 12/2016

* cited by examiner

*Primary Examiner* — Kwang-Su Yang
(74) *Attorney, Agent, or Firm* — James M. Wu; JW Law Group

(57) ABSTRACT

An LED display device and a method for driving the same are disclosed. The LED display device includes a plurality of pixel units being coupled to the row and column lines. In each of the row periods, the method comprises: displaying a display data in a manner of packet-by-packet; and pre-charging the parasitic capacitors between the row and column line by use of a reset voltage to implement a reset between the successive groups. According to the disclosure, a reset is performed between the packets in each row period to reduce the interference to the low grayscale image by the high grayscale image, such that the dynamic display quality of the image is improved.

8 Claims, 4 Drawing Sheets

LED DISPLAY DEVICE AND METHOD FOR IMPROVING IMAGE QUALITY USING A SCHEME OF ROW LINE RESETTING

CROSS-REFERENCE TO RELATED APPLICATION

This application claims the benefit of Chinese Patent Application No. 201610867290.9, filed on Sep. 29, 2016, which is incorporated herein by reference in its entirety.

BACKGROUND OF THE DISCLOSURE

Field of the Disclosure

The present disclosure is related to the field of display technology, and in particular, to an LED display device and a method for driving the same.

Background of the Disclosure

Light-emitting diodes (LEDs) are diodes that use the combination of minority and majority carriers in PN junctions to emit light. An LED becomes conducting by applying a forward voltage between PN junction so that electrical energy is turned into light. An LED display device uses an LED as a pixel unit wherein the luminance of the LED corresponds to the grayscale data to be displayed.

A liquid crystal display (LCD) device is different from the LED display device. In the LCD display device, the light transmittance of the pixel unit is changed due to the rotation of liquid crystal molecules, so that the intensity of the light generated by the backlight source is changed after the light passes through the liquid crystal molecular layer, whereas the LED display device changes display grayscales by controlling the luminance of the light source itself. Comparing with the LCD display device, the LED display device has low power consumption, rapid refresh speed and wide view angle, which can be used in strong light environment and low temperature environment. Therefore, the LED display devices are particularly applicable to be used in the outdoor display screens for displaying texts, images and videos.

In conventional LED display devices, usually the LEDs are driven by a constant current source controlled by a PWM signal. Due to the physical characteristics of the LED, the luminance of the lit LED is relevant to the value of the driving current. Further, by controlling the duty cycle of the PWM signal, the effective lighting time of the LED can be adjusted, therefore the luminance of the LED can be changed.

Because parasitic capacitances exist between row and column lines, displaying high grayscale images will cause interference to the display of low grayscale images when the high grayscale images and the low grayscale images are continuously displayed, so that image sticking occurs during the display of the low grayscale images, which results in image quality degradation.

SUMMARY OF THE DISCLOSURE

In view of the above, the disclosure is to provide an LED display device and a method for driving the same, in which a reset module is used for resetting in the row lines in order to improve the dynamic display quality of an image.

According to one aspect of the disclosure, there is provided a method for driving an LED display device, the LED display device includes a plurality of pixel units being coupled to the row and column lines. In each row period, the method comprises: displaying a display data in a manner of packet-by-packet; and pre-charging parasitic capacitors between row and column lines by use of a reset voltage so as to implement a reset between a plurality of successive packets.

Preferably, the method further comprises: dividing said display data into packets by weight, wherein said weight corresponds to a LED lighting duration time; and arranging said plurality of packets in ascending order of weight in each row period.

Preferably, the plurality of packets are divided into a first group of packets and a second group of packets, each packet in a first group of packets has a weight less than a weight of any packet in a second group of packets.

Preferably, each packet in the second group of packets is further divided into a plurality of sub-cycles, and a reset is performed between the plurality of sub-cycles.

Preferably, a first display data is displayed in said first group of packets, a second display data having a value larger than that of the first display data is displayed in said first group of packets and said second group of packets.

Preferably, the value of said first display data is greater than a first threshold value, and the value of said second display data is smaller than said first threshold value.

Preferably, the method further comprises: dividing said second display data into a first sub-data and a second sub-data, wherein said first sub-data and said second sub-data are displayed in said first group of packets and said second group of packets, respectively.

Preferably, the value of said first sub-data is greater than a second threshold value, and the value of said second sub-data is smaller than said second threshold value.

Preferably, a total weight of said first group of packets corresponds to a LED lighting duration time greater than or equal to 5 times of a system clock period.

Preferably, the reset performed between the packets is irrelevant to said value of said display data.

Preferably, the display data is a grayscale data.

According to a second aspect of the disclosure, there is provided an LED display device comprising: a plurality of row lines and a plurality of column lines; a row driver being coupled to said plurality of row lines, and configured to provide selecting signals; a column driver being coupled to said plurality of column lines, configured to provide driving signals corresponding to a display data; a plurality of pixel units, wherein each of said plurality of pixel units comprises an LED being coupled to one of said plurality of row lines and to one of said plurality of column lines; and a blanking module being coupled to said plurality of column lines, wherein said blanking module is configured to, between a plurality of successive packets in each row period, pre-charge parasitic capacitors between said plurality of row lines and column lines by use of a reset voltage, so as to implement a reset between said plurality of successive packets.

Preferably, the display data is grayscale data.

In the embodiment of the disclosure, the method for driving the LED display device pre-charges parasitic capacitors between the plurality of row and column lines by use of a reset voltage to implement a reset between the plurality of successive packets. According to the method, a reset is performed between the packets in each row period to reduce the interference to the low grayscale images by the high grayscale images, so as to improve the dynamic display quality of the images.

In a preferred embodiment, the high weighted packets are further divided into a plurality of sub-cycles, and a reset is performed between the sub-cycles, to further reduce the interference to the low grayscale images by the high grayscale images.

In a preferred embodiment, the high grayscale data and the low grayscale data are divided differently. For example, the low grayscale data is displayed in the first group of packets with a lower weight, and the high grayscale data is divided into a first sub-data and a second sub-data, wherein the first sub-data is displayed in the first group of packets with a lower weight and the second sub-data is displayed in the second group of packets with a higher weight. In this case, the interference to low grayscale images by the high grayscale images may be reduced or eliminated by the intra-row resetting and the packet-by-packet displaying of the grayscale data.

BRIEF DESCRIPTION OF THE DRAWINGS

The above and other objects, advantages and features of the present invention will become more fully understood from the detailed description given below in connection with the appended drawings, and wherein.

DETAILED DESCRIPTION OF THE DISCLOSURE

Figure 1:
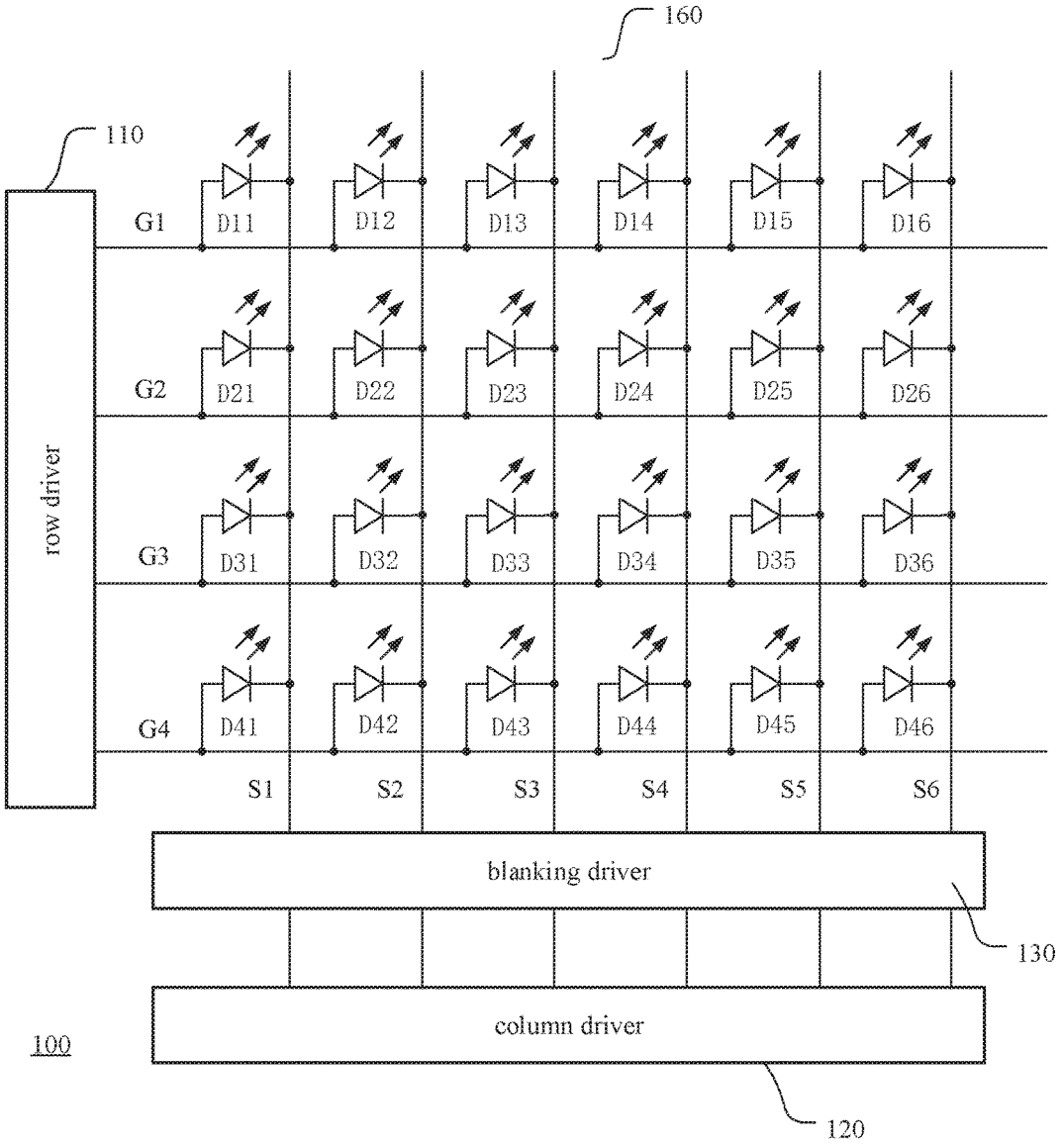
FIG. 1 is a schematic diagram of an LED display device according to an embodiment of the disclosure.

Exemplary embodiments of the present disclosure will be described in more details below with reference to the accompanying drawings. In the drawings, like reference numerals denote like members. The figures are not drawn to scale, for the sake of clarity. Moreover, some well-known parts may not be shown in the figures.

Some particular details of the present disclosure will be described below, such as exemplary semiconductor structures, materials, dimensions, process steps and technologies of the semiconductor device, for better understanding of the present disclosure. However, it can be understood by one skilled person in the art that these details are not always essential for but can be varied in a specific implementation of the disclosure.

In the present disclosure, the term "frame" indicates a picture that can be displayed separately in a video image, and the term "division" means that the display period of one picture is divided into a plurality of sub-periods to display and the grayscale of each pixel is displayed by means of the time cumulative effects of the plurality of sub-periods.

FIG. 1 is a schematic diagram of an LED display device according to an embodiment of the disclosure. The LED display device 100 includes a row driver 110, a column driver 120, a blanking driver 130 and an LED matrix 160.

The LED matrix 160 includes a plurality of LEDs arranged in rows and columns. As an example, an LED matrix 160 of 4 rows*6 columns is shown in FIG. 1. An LED includes a cathode and an anode, and the LED is lightened when a forward voltage is applied between the cathode and the anode. The anodes of the plurality of LEDs in one row are coupled together to a respective row line. For example, the anodes of the LEDs D11-D16 in a first row are coupled together to the row line G1. The cathodes of the plurality of LEDs in one column are coupled to a respective column line. For example, the cathodes of the first column LEDs D11-D41 are coupled together to the column line S1.

The row driver 110 is coupled to the plurality of row lines G1-G4, and provides selecting signals. The row driver 110 includes a plurality of selective switches, which are coupled to the plurality of row lines respectively. Each of the row lines can be coupled to high potential terminal through a corresponding selective switch which is turned on.

The column driver 120 is coupled to the plurality of column lines S1-S6, and provides driving signals corresponding to the display data. In some embodiments, the display data can be a grayscale data. The column driver 120 includes a plurality of constant current sources coupled to the plurality of row lines respectively. When the row driver 110 selects a plurality of LEDs in one row, as described above, the anodes of the selected LEDs are coupled to a high potential terminal, and the cathodes of the selected LEDs are coupled to a plurality of constant current sources respectively, so that forward voltages are applied between the anodes and the cathodes of the selected LEDs and thus the selected LEDs are lightened.

The blanking module 130 is coupled to the plurality of column lines S1-S6. The blanking module 130 includes a plurality of reset switches coupled to the plurality of column lines respectively. In a reset phase, each of the plurality of column lines is coupled to a reset voltage. The reset voltage has a predetermined value so that the capacitors between the row and column lines are pre-charged.

In the above-described LED display device 100, each of the plurality of LEDs in the LED matrix 160 is used as a pixel unit. It will be understood that each pixel in the LED display device 100 may include one or more pixel units. For example, to display color images, three LEDs can be used to display the red, green and blue color components, respectively, each of the three LEDs produces light in a corresponding color according to its own light emission characteristics, or uses additional filters to produce light in a corresponding color.

When the LED display device 100 displays a dynamic image, the row driver 110 performs, for example, a progressive scan, so that the row lines are coupled to the high level one by one. Accordingly, the plurality of constant current sources in the column driver 120 apply constant current to the plurality of LEDs in the row, respectively. The column driver 120 controls the duty cycles of the PWM signals according to the display data of the corresponding line of the image so as to change the effective lighting time of the plurality of LEDs in the corresponding row, thereby the luminance of the plurality of LEDs are adjusted. In this manner, one pixel line of the image can be displayed.

In one frame period, the display data of the image is provided row by row to the column driver 120, and the luminance of the plurality of LEDs in the corresponding row of the LED matrix 160 is sequentially controlled to realize the display of the image. According to the embodiment of the disclosure, a reset phase is introduced between the successive frame periods, wherein the row lines are coupled to a reset voltage sequentially. Further, in a frame period, a reset voltage is introduced between the drivings of the successive rows, wherein the corresponding row line is coupled to the reset voltage. Further, during the period of one row driving, a row is divided into packets to be driven and a voltage reset is performed between successive packets, wherein the corresponding row is coupled to the reset voltage.

With the LED display device 100 according to the embodiment of the disclosure, a plurality of LEDs in a corresponding row are coupled to a reset voltage, between the driving operations of successive frames, between the driving operations of successive rows in one frame and between the driving operations of successive packets in one row, so that the parasitic capacitors between the row and column lines are pre-charged. The reset voltage has a predetermined value, thereby eliminating interference between a high grayscale signal and a low grayscale signal in successive when a dynamic image is displayed.

Figure 2:
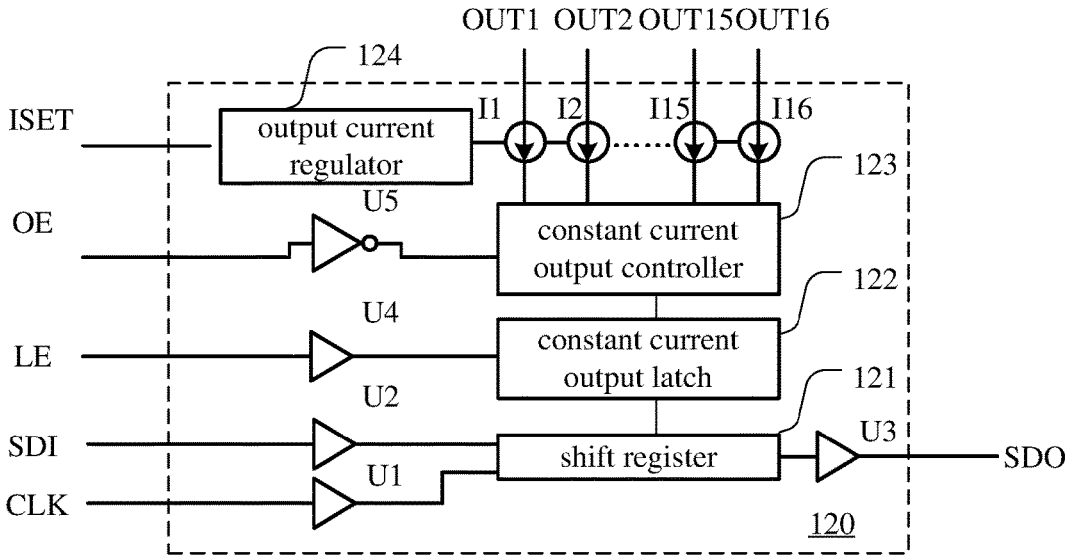
FIG. 2 is a schematic circuit diagram of a column driver of the LED display device in FIG. 1.

FIG. 2 is a schematic circuit diagram of a column driver of the LED display device in FIG. 1. The column driver 120 is a constant current driving module that generates a constant current output based on serial data. For example, an LED constant current driver chip ET6204 from Etek Microelectronics company may be employed.

The column driver 120 includes a shift register 121, a constant current output latch 122, a constant current output controller 123, an output current regulator 124, a plurality of constant current sources I1-I16, buffers U1-U4 and an inverter U5.

The shift register 121 receives a clock signal CLK and a serial input signal SDI from the buffers U1 and U2, respectively. For example, the shift register 121 is shifted at the rising edge of the clock signal CLK. The shift register 121 receives a serial output data SDO from the buffer U3.

The constant current output latch 122 is coupled to the shift register 121 and receives a latch enable signal LE through the buffer U4. When the latch enable signal LE is valid, the constant current output latch 122 receives the serial data from the shift register 121. When the latch enable signal LE is invalid, the constant current output latch 122 latches the serial data that has been received.

The constant current output controller 123 is coupled to the constant current output latch 122 and receives a gate enable signal OE through the inverter U5. When the gate enable signal QE is invalid, a plurality of output terminals OUT1-OUT16 provide constant output currents. When the gate enable signal OE is valid, the plurality of output terminals OUT1-OUT16 are turned off, so that there is no constant output current.

A plurality of constant current sources I1-I16 are coupled to the constant current output controller 123. The constant current output controller 123 generates a PWM signal having a corresponding duty cycle according to the serial data, and respectively controls the conduction states of the plurality of constant current sources I1-I16, thereby changing the effective lighting time of the LEDs.

The output current regulator 124 receives the current setting signal ISET for setting the current values of the plurality of constant current sources I1-I16. The current setting signal ISET can be generated by an external resistor.

In the embodiment, the shift register 121 provides the serial output data SDO, so that the plurality of column drivers 120 can be coupled in series with each other. Although the LED constant driving modules each have a limited quantity of output terminals, more output terminals can be provided by coupling a plurality of column drivers 120 in series, so that a corresponding number of column lines can be driven.

Figure 3:
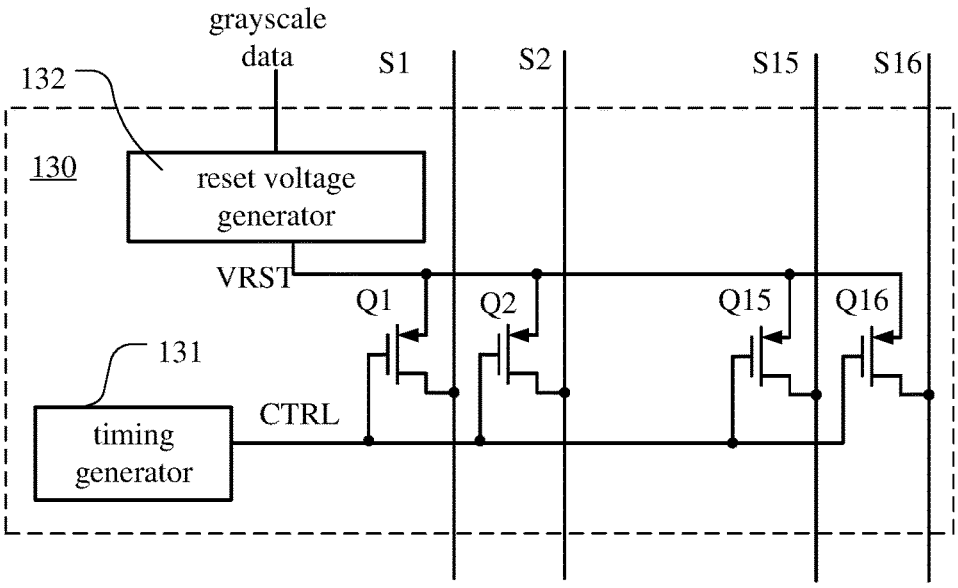
FIG. 3 is a schematic circuit diagram of a blanking module of the LED display device in FIG. 1.

FIG. 3 is a schematic circuit diagram of a blanking module of the LED display device in FIG. 1. The blanking module 130 includes a plurality of reset switches Q1-Q16, a timing generator 131 and a reset voltage generator 132.

Each of the plurality of reset switches Q1-Q16 has a first terminal, a second terminal and a control terminal, in which the current flows from the first terminal to the second terminal when the switch is turned on. The switch may be a metal oxide semiconductor field effect transistor (MOSFET) or a bipolar transistor. If the switch is a MOSFET, the first terminal, the second terminal and the control terminal of the switch are source, drain and gate, respectively.

In this embodiment, the control terminals of the reset switches Q1-Q6 are together coupled to the timing generator 131, the first terminals are together coupled to the reset voltage generator 132, and the second terminals are respectively coupled to a corresponding column line. The timing generator 131 generates a reset control signal CTRL synchronized with the successive frame driving signal, row driving signals and packet driving signals. The reset switches are switched from an on-state to an off-state between the successive frames, the successive rows in one frame, and the successive packets in one row, so that the plurality of column lines S1-S16 are coupled to the reset voltage generator 132 to receive the reset voltage VRST for pre-charging the parasitic capacitors between the column and row lines and thus a reset is performed.

In an alternative embodiment, the reset voltage generator 132 can receive the display data, e.g. grayscale data, and set the respective reset voltages VRST for the plurality of column lines according to the grayscale data. To this end, the reset voltage generator 132 has an input terminal for receiving the grayscale data and a plurality of output terminals for providing a plurality of reset voltages VRST, each output terminal is coupled to a corresponding one of the column lines, so that the interference between the continuous grayscale images can be further compensated.

Figure 4:
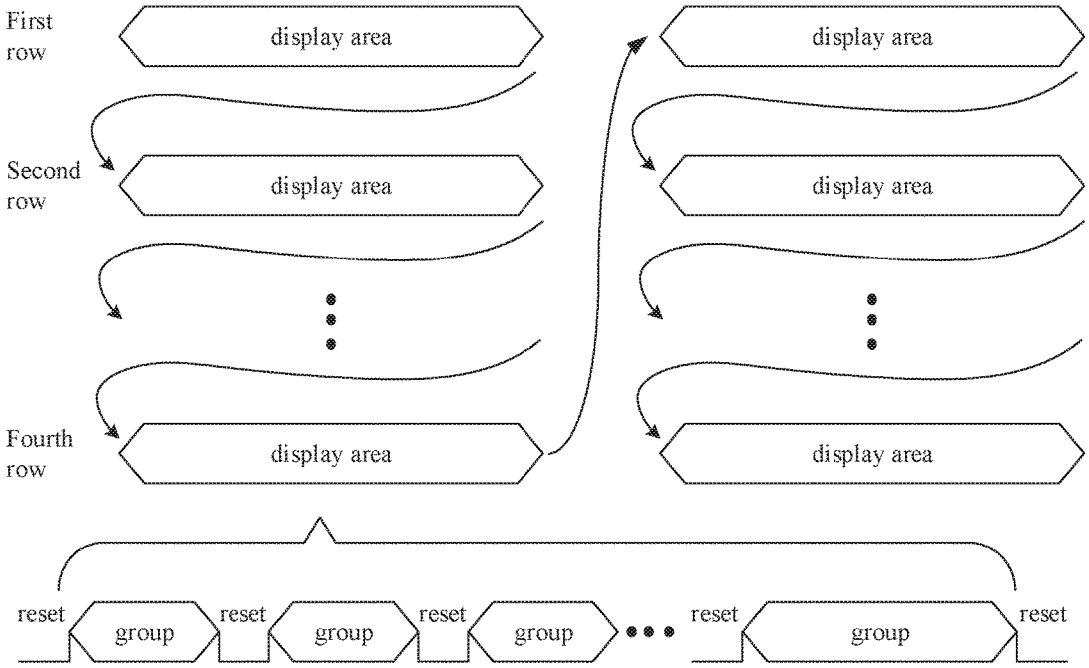
FIG. 4 is a schematic waveform diagram showing an intra-row reset.

FIG. 4 is a schematic waveform diagram showing intra-row resetting. The LED display device 100 introduces a reset between a plurality of display driving phases.

The LED display device 100 displays the dynamic images at successive frame periods. Between the successive frame periods, the reset module 120 couples the plurality of column lines S1-S16 to the reset voltage generator 130, pre-charges the parasitic capacitors between the row and column lines by use of the reset voltage VRST, so that a reset is performed between the frame periods.

In one frame period, the LED display device 100, for example, performs progressive scan at successive row periods in order to sequentially display the display data, e.g. grayscale data, of the corresponding rows of the image. Between the successive row periods, the reset module 120 couples the plurality of column lines S1-S16 to the reset voltage generator 130, pre-charges the parasitic capacitors between the row and column lines by use of the reset voltage VRST, so that a reset is implemented between the row periods.

In one row period, the LED display device 100 divides the grayscale data into a plurality of packets according to weights of the grayscale data, wherein the weights correspond to the LED lighting duration time. In one row period, the LED display device 100 displays each bit of the grayscale data packet-by-packet. Preferably, the plurality of packets are arranged by weight in ascending order.

Between the successive packets, the reset module 120 couples the plurality of column lines S1-S16 to the reset voltage generator 130, pre-charges the parasitic capacitors between the row and column lines by use of the reset voltage VRST, so that a reset is implemented between the packets. The reset between the packets is irrelevant to the value of the grayscale data.

Figure 5:
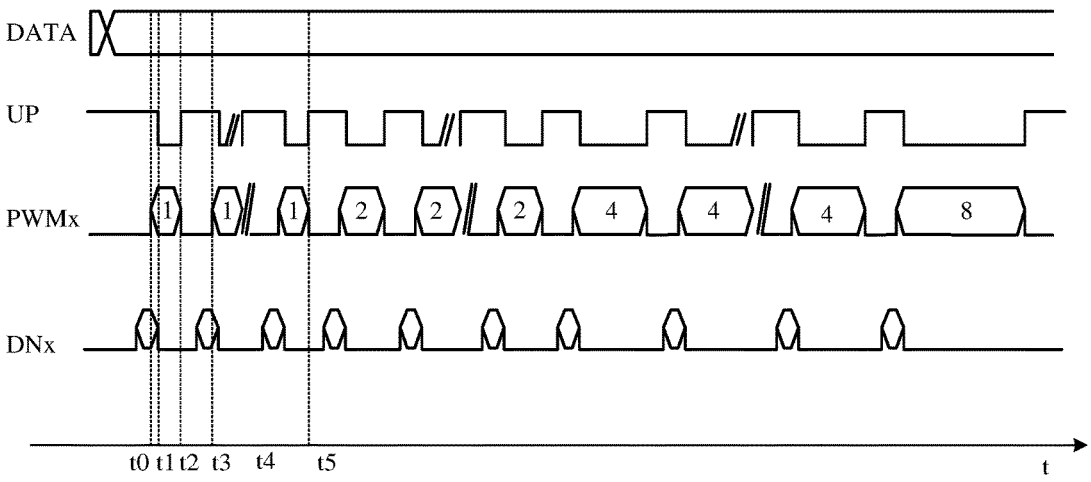
FIG. 5 is a schematic waveform diagram showing an intra-row division and reset.

FIG. 5 is a schematic waveform diagram showing the intra-row division and reset. In FIG. 5, DATA represents the variation of the grayscale data with time, PWMx represents the variation of the pulse width modulation signal of the xth channel with time, UP represents the variation of the pull-up blanking signal with time and DNx represents the variation of the pull-down signal of the x-channel with time.

It should be noted that in the example shown in FIG. 4, the LED display device 100 performs division in accordance with the weights of the grayscale data DATA in one row period, and displays every bit of the grayscale data DATA packet-by-packet. Further, the LED display device 100 divides the grayscale data DATA in one row period into a plurality of packets in accordance with the weight of the grayscale data in the example shown in FIG. 5.

In an embodiment, grayscale data for a row period is divided into eight packets, which are arranged by weight in ascending order. The minimum weight corresponds to the minimum of the lighting duration time of the LED.

Preferably, the eight packets are divided into two groups, i.e. a first group of packets and a second group of packets. Every packet in the first group of packets has a weight less than that of any packet in the second group of packets. Every packet in the second group of packets is further divided into a plurality of sub-cycles. The total weight of the first group of packets corresponds to the LED lighting duration time, which is greater than or equal to 5 times of system clock.

Preferably, different divisions are performed in accordance with the value of the grayscale data. The grayscale data is divided into two types of grayscale data, i.e. a first gray data and a second gray data. The value of the first grayscale data is greater than a first threshold value, and the value of the second grayscale data is less than the first threshold value. The first grayscale data is displayed in the first group of packets, and the second grayscale data is displayed in the first group of packets and the second group of packets. Before the second grayscale data is displayed, the second grayscale data is further divided into a first sub-data and a second sub-data. The value of first sub-data is greater than a second threshold value, the value of the second sub-data is less than the second threshold value, and the first sub-data and the second sub-data are displayed in the first group of packets and the second group of packets respectively. Therefore, the high and low grayscale data are displayed without interference with each other, which can reduce the occurrence of the interference between the high and low grayscale data in the LED display device.

As described above, the timing generator 131 in the blanking module 130 generates a pull-up reset signal UP synchronized with the successive frame driving signals, row driving signals and packet driving signals. The pull-down signal DNx is, for example, an inverted signal of the gate enable signal OE of the constant current output controller in the row driver 110. The pull-up blanking signal UP is, for example, an in-phase signal of the latch enable signal LE of the constant current output latch in the row driver 110. In this embodiment, the pull-up reset signal UP and the pull-down signal DNx are both valid at high voltage level and invalid at low voltage level.

In the embodiment shown in FIG. 5, the constant current output latch 122 divides a row period into packets, and divides a packet into a plurality of sub-cycles. The time periods of the successive packet periods correspond to the weights of the corresponding bits of the grayscale data, respectively. For example, the time period t0-t5 of the packet periods corresponds to a sub-cycle of the weight 1 of the least significant bit of the grayscale data.

At time t0, the first sub-cycle of the first group of packets in the row period starts from the least significant bit of the grayscale data. The pull-down signal DNx is turned to be valid and the constant current output controller 123 in the row driver 110 controls the constant current source to provide a plurality of constant current outputs under the control of the pull-down signal DNx.

At time t1, the pull-up blanking signal UP is turned to be valid. The constant current output controller 123 in the row driver 110 receives the serial data from the constant current output latch 122. In the embodiment, the constant current output controller 123 receives a value of least significant bit in a sub-cycle, and provides or stops constant current output in accordance with the value.

At time t2, the pull-up blanking signal UP is turned to be invalid. The constant current output controller 123 in the row driver 110 stops receiving the serial data from the constant current output latch 122. The pull-up blanking signal UP maintains valid for a time period corresponding to the weight of the least significant bit, that is, the constant current output state is maintained for the time period corresponding to the weight. Therefore, in the embodiment, the constant current output controller 123 maintains the constant current output state for a time period corresponding to the weight of the least significant bit in accordance with the weight of the least significant bit, in the sub-cycles.

At time t3, the pull-down signal DNx is again turned to be valid, to complete the first sub-cycle of the first group of packets in the row period, and begins a second sub-cycle of the second group of packets. The driving period of the first group of packets is completed until time t5.

In the time period t2-t3, the pull-up blanking signal UP and the pull-down signal DNx are both invalid, the reset control signal CTRL generated by the timing generator 131 in the reset module 120, is turned to be valid, so that the reset voltage VRST is applied on the column lines to reset during the sub-cycles.

According to a method of the present disclosure, in one row period, the LED display device 100 performs division in accordance with the weights of the grayscale data, divides the weights of the grayscale data into a plurality of sub-cycles, and displays every bit of the grayscale data at per sub-cycle. A reset voltage is used to pre-charge the parasitic capacitors between the row and column lines so as to implement a reset between the successive sub-cycles.

In an alternative embodiment, any one of the following reset can be performed: a reset between the sub-cycles, a reset between the packets, a reset between the rows and a reset between the frames. Unlike the reset between the frames, the reset between the sub-cycles, the reset between the packets and the reset between the rows can configure respective reset voltages for each of the plurality of column lines according to the gray-scale data, which can better compensate for the interference between successive gray-scale images.

It should also be understood that the relational terms such as "first", "second", and the like are used in the context merely for distinguishing one element or operation from the other element or operation, instead of meaning or implying any real relationship or order of these elements or operations. Moreover, the terms "comprise", "comprising" and the like are used to refer to comprise in nonexclusive sense, so that any process, approach, article or apparatus relevant to an element, if follows the terms, means that not only said element listed here, but also those elements not listed explicitly, or those elements inherently included by the process, approach, article or apparatus relevant to said element. If there is no explicit limitation, the wording "comprise a/an . . . " does not exclude the fact that other elements can also be included together with the process, approach, article or apparatus relevant to the element.

Although various embodiments of the present invention are described above, these embodiments neither present all details, nor imply that the present invention is limited to these embodiments. Obviously, many modifications and changes may be made in light of the teaching of the above embodiments. These embodiments are presented and some details are described herein only for explaining the principle of the invention and its actual use, so that one skilled person can practice the present invention and introduce some modifications in light of the invention. The invention is intended to cover alternatives, modifications and equivalents that may be included within the spirit and scope of the invention as defined by the appended.

The invention claimed is:

1. A method for driving a light emitting diode (LED) display device, said LED display device comprising pixel units being coupled to row and column lines, in each row period, said method comprising:

displaying a display data in a manner of packet-by-packet;

pre-charging parasitic capacitors between row and column lines by use of a reset voltage so as to implement a reset between a plurality of successive packets;

dividing said display data into packets by weight, wherein said weight corresponds to an LED lighting duration time; and arranging said plurality of packets in ascending order of weight in each row period, wherein each packet in a first group of packets has a weight less than a weight of any packet in a second group of packets, and wherein each packet in said second group of packets is further divided into a plurality of sub-cycles, and a reset is performed between said plurality of sub-cycles.

2. The method according to claim 1, wherein a first display data is displayed in said first group of packets, and a second display data having a value larger than that of the first display data is displayed in said first group of packets and said second group of packets.

3. The method according to claim 2, wherein the value of said first display data is greater than a first threshold value, and the value of said second display data is smaller than said first threshold value.

4. The method according to claim 3, further comprising: dividing said second display data into a first sub-data and a second sub-data, wherein said first sub-data and said second sub-data are displayed in said first group of packets and said second group of packets, respectively.

5. The method according to claim 4, wherein the value of said first sub-data is greater than a second threshold value, and the value of said second sub-data is smaller than said second threshold value.

6. The method according to claim 1, wherein a total weight of said first group of packets corresponds to a LED lighting duration time greater than or equal to 5 times of a system clock period.

7. The method according to claim 1, wherein said reset performed between said packets is irrelevant to the value of said display data.

8. The method according to claim 1, wherein said display data is a grayscale data.

* * * * *